US006981813B1

(12) United States Patent
Thomas

(10) Patent No.: US 6,981,813 B1
(45) Date of Patent: Jan. 3, 2006

(54) NOTEPEN

(76) Inventor: Marcell Thomas, 3220 Avenue H 5B, Brooklyn, NY (US) 11210

( * ) Notice: Subject to any disclaimer, the term of this patent is extended or adjusted under 35 U.S.C. 154(b) by 87 days.

(21) Appl. No.: 10/866,558

(22) Filed: Jun. 9, 2004

Related U.S. Application Data

(60) Provisional application No. 60/477,596, filed on Jun. 10, 2003.

(51) Int. Cl.
*B43K 29/00* (2006.01)

(52) U.S. Cl. ..... 401/195

(58) Field of Classification Search ..... 401/52, 401/195
See application file for complete search history.

(56) References Cited

U.S. PATENT DOCUMENTS 2,301,364 A * 11/1942 Bruck et al. ..... 401/52
2,512,168 A * 6/1950 Moore ..... 206/389
3,963,358 A * 6/1976 Houser ..... 401/195
4,872,775 A * 10/1989 Chang ..... 401/52
6,135,661 A 10/2000 Houser
6,247,864 B1 6/2001 Walsh
6,283,661 B1 * 9/2001 Connors ..... 401/195

* cited by examiner

*Primary Examiner*—David J. Walczak

(57) ABSTRACT

A pen and rolled note paper system for providing note paper and a writing instrument in a single device. The system includes a roller assembly, a pen member, a paper roll, a housing, and a cap. The paper roll is positionable on the roller assembly and is accessible by the user through a slot in the housing. The paper roll is moved forward to be written on and torn off or moved backwards to manually store the written information for the user to review and use later. The pen member is slideably received in the roller assembly which in turn is positioned within the housing. The pen member may be removed from the roller assembly for use, or used while still received by the roller assembly as the user desires. The cap member protects the pen member and the knob member when the system is not in use.

5 Claims, 3 Drawing Sheets

NOTEPEN

I. CROSS-REFERENCE TO RELATED APPLICATIONS

This application claims the benefit of U.S. Provisional Application No. 60/477,596, filed Jun. 10, 2003.

II. BACKGROUND OF THE INVENTION

The present invention relates to pens and pencils and more particularly pertains to a new pen and rolled note paper system for providing notepaper and a pen in a single units.

III. DESCRIPTION OF THE PRIOR ART

The use of pens and pencil with paper is known in the prior art. More specifically, pens and pencils heretofore devised and utilized are known to consist basically of familiar, expected and obvious structural configurations, notwithstanding the myriad of designs encompassed by the crowded prior art which have been developed for the fulfillment of countless objectives and requirements.

Illustrative examples include U.S. Pat. No. 4,872,775; U.S. Pat. No. 6,135,661; and U.S. Pat. No. 6,247,864.

In these respects, the pen and rolled note paper system according to the present invention substantially departs from the conventional concepts and designs of the prior art, and in so doing provides an apparatus primarily developed for the purpose of for providing notepaper and a pen in a single units.

IV. SUMMARY OF THE INVENTION

In view of the foregoing disadvantages inherent in the known types of pens and pencils with writing pads now present in the prior art, the present invention provides a new pen and rolled note paper system construction wherein the same can be utilized for providing notepaper and a pen in a single units.

To attain this, the present invention generally comprises a roller assembly, a pen member, a paper roll, a housing, and a cap. The paper roll is positionable on the roller assembly and is accessible by the user through a slot in the housing. The paper roll is moved forward to be written on and torn off or moved backwards to manually store the written information for the user to review and use later. The pen member is slideably received in the roller assembly which in turn is positioned within the housing. The pen member may be removed from the roller assembly for use, or used while still received by the roller assembly as the user desires. The cap member protects the pen member and the knob member when the system is not in use.

There has thus been outlined, rather broadly, the more important features of a pen and rolled note paper system in order that the detailed description thereof that follows may be better understood, and in order that the present contribution to the art may be better appreciated. There are additional features of the pen and rolled note paper system that will be described hereinafter and which will form the subject matter of the claims appended hereto.

In this respect, before explaining at least one embodiment of the pen and rolled note paper system in detail, it is to be understood that the pen and rolled note paper system is not limited in its application to the details of construction and to the arrangements of the components set forth in the following description or illustrated in the drawings. The pen and rolled note paper system is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present pen and rolled note paper system. It is important, therefore, that the claims be regarded as including such equivalent constructions insofar as they do not depart from the spirit and scope of the present invention.

It is an object of the present invention to provide a pen and rolled note paper system which has all of the advantages of the prior art and none of the disadvantages.

It is another object of the present invention to provide a pen and rolled note paper system which may be easily and efficiently manufactured and marketed.

It is another object of the present invention to provide a pen and rolled note paper system which is of durable and reliable construction.

It is yet another object of the present invention to provide a pen and rolled note paper system which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
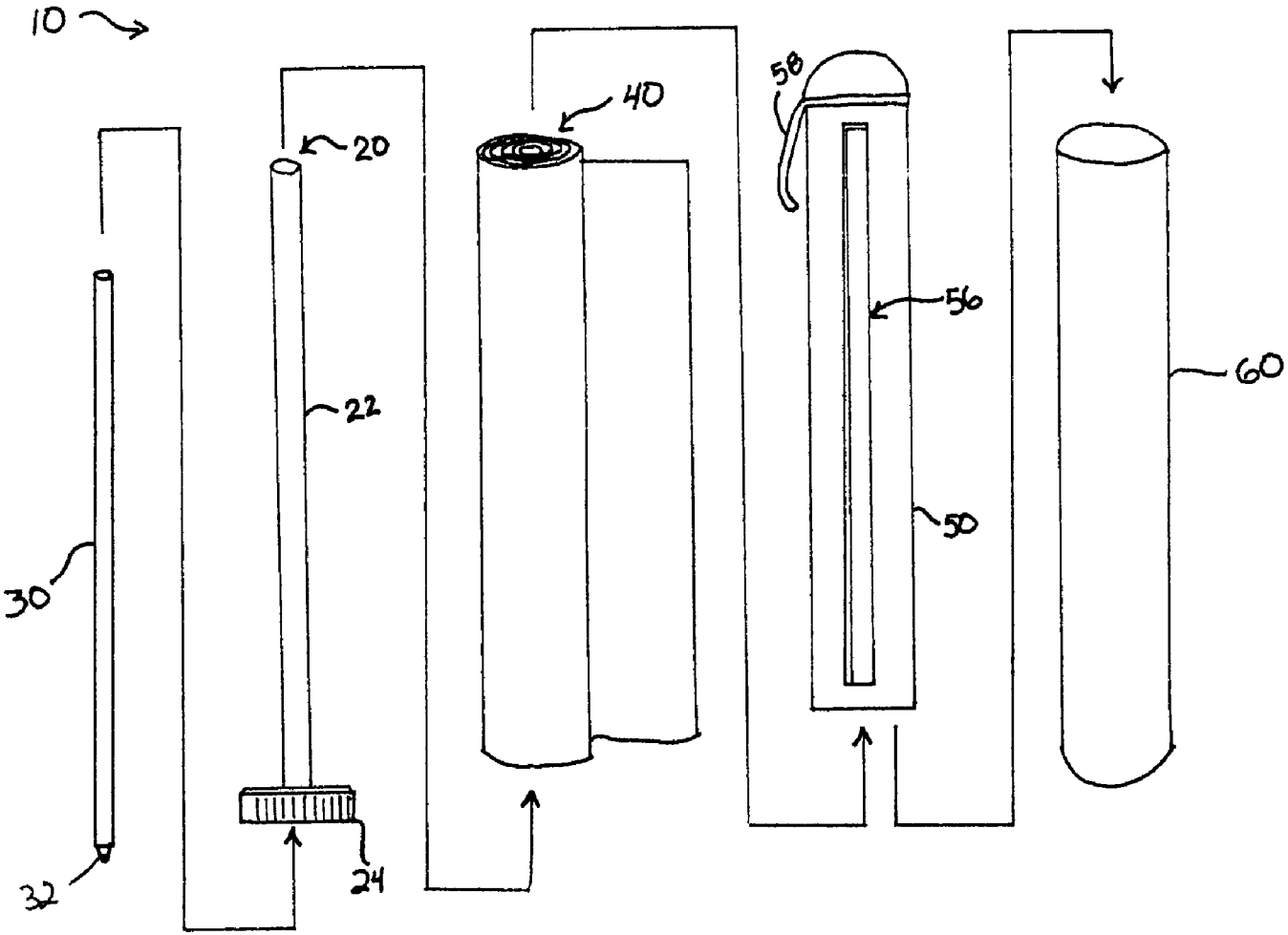
FIG. 1 is a schematic exploded front perspective view of a new pen and rolled note paper system according to the present invention.
Figure 2:
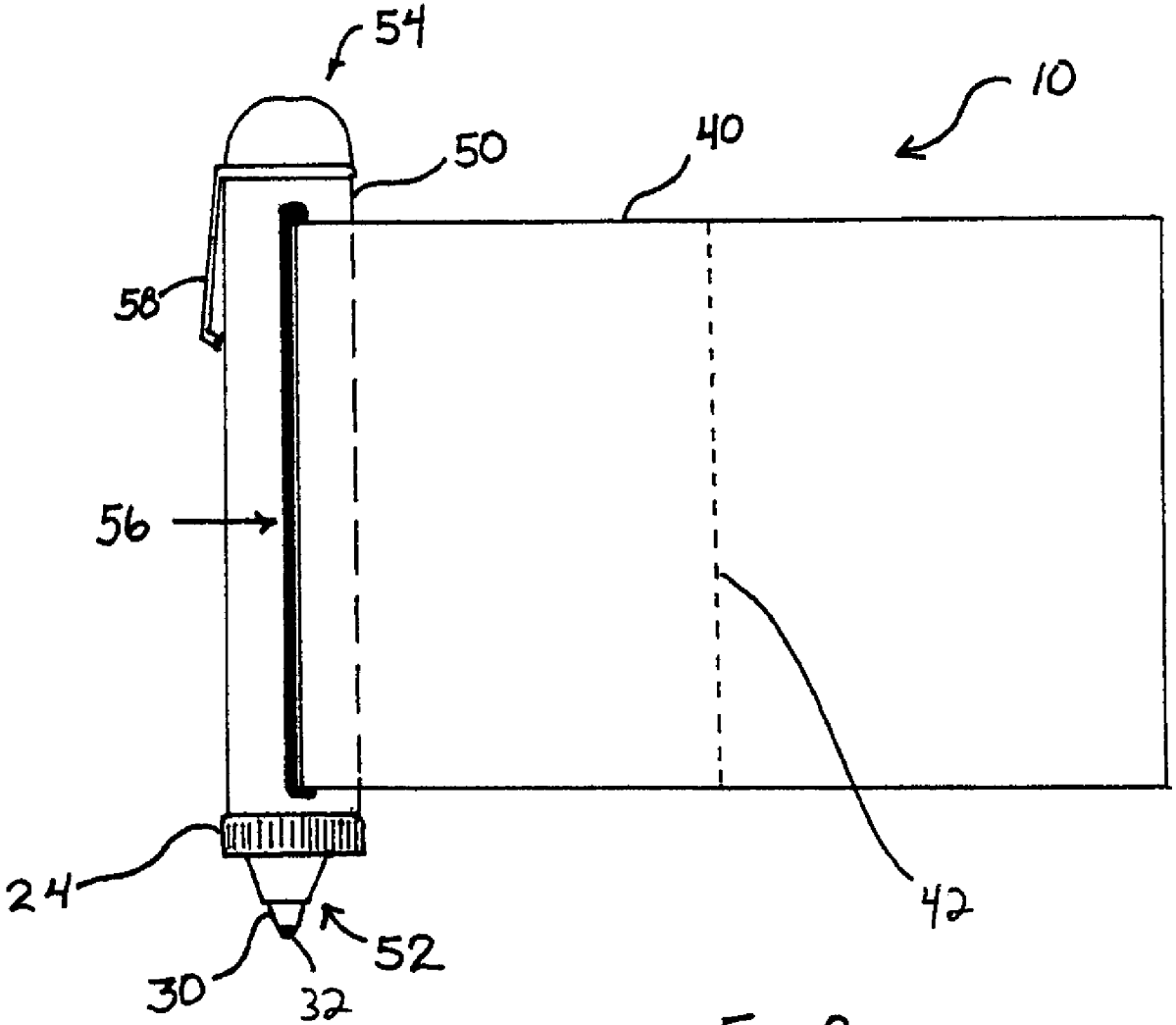
FIG. 2 is a schematic perspective view of the present invention.
Figure 3:
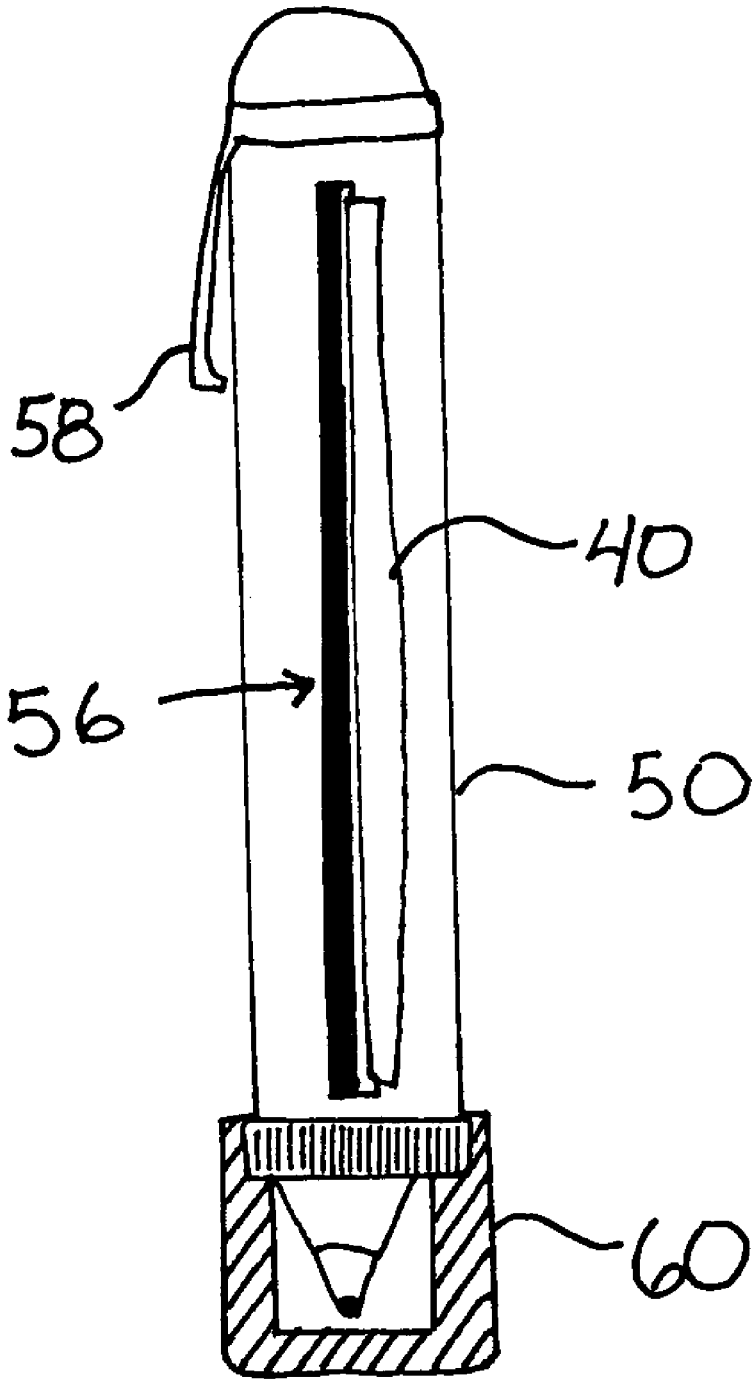
FIG. 3 is a schematic perspective view of the present invention.

With reference now to the drawings, and in particular to FIGS. 1 through 3 thereof, a new pen and rolled note paper system embodying the principles and concepts of the present invention and generally designated by the reference numeral 10 will be described.

As best illustrated in FIGS. 1 through 3, the pen and rolled note paper system 10 generally comprises a roller assembly 20, a pen member 30, a paper roll 40, a housing 50, and a cap.

The roller assembly 20 preferably further comprises a elongate tube member 22 and a knob member 24. The elongate tube member 22 is hollow and substantially cylindrical. The elongate tube member 22 has a first end and a second end. The knob member 24 is preferably operationally coupled to the first end of the elongate tube member 22. The knob member 24 has a bore extending therethrough which is aligned with the hollow center of the elongate tube member 22. Preferably the knob member 24 has a knurled or ridged perimeter wall to facilitate being grasped by a human hand. The knob 24 moves forward to allow the paper to be written on and backwards to manually store the written information.

The pen member 30 is slideably receivable in the knob member 24 and the elongate tube member 22 with a writing tip 32 extended from the bore of the knob member 24. The pen member 30 may be removed from the roller assembly 20 for use, or used while still received by the roller assembly 20 as the user desires.

The paper roll 40 is positionable on the roller assembly 20. Preferably the paper roll 40 has an overall length of approximately 72 inches. Most preferably, the paper roll 40 has a plurality of perforations 42 to facilitate tearing the paper to a desired length prior to use.

In a preferred embodiment, the paper roll 40 has a width of 4 inches and is perforated every three inches. Thus the user may utilize 4 inch by 3 inch notes dispensed from the paper roll 40.

The housing 50 is generally cylindrical with an open first end and a closed second end. The housing 50 is generally hollow and has a slot 56 through a perimeter wall. The slot 56 is used to feed paper from the paper roll 40 to the user as desired. The rolling assembly, pen member 30, and paper roll 40 are positionable within the housing 50. The knob member 24 extends from the open end 52 of the housing 50 to facilitate access by the user.

In an embodiment, the housing 50 further comprises a clip member 58 adjacent to the closed end 54. The clip member 58 is adapted for coupling the system 10 to clothing of the user.

The cap member 60 is removably couplable to the housing 50 adjacent to the open end 52. The cap member 60 protects the pen member 30 and the knob member 24 when the system is not in use.

In a further embodiment, the cap member 60 is transparent.

In yet a further embodiment, the system 10 has an overall length of 5½ inches and a circumference of 2½ inches.

In use, the user removes the cap from the housing, unrolls the desired length of paper from the paper roll through the slot and tears off the paper at a perforation. The user may then write with the pen member while the pen member is within the roller assembly, or the user may remove the pen member from the roller assembly prior to use. Alternately, the user may write on the paper and roll the paper back into the housing to manually store and keep the written information inside the pen for reviewing and later use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A pen and rolled note paper system comprising (a) a roller assembly having a elongate tube member and a knob member, said elongate tube member being hollow and substantially cylindrical, said elongate tube member having a first end and a second end, wherein said knob member is operationally coupled to said first end of said elongate tube member, said knob member having a bore extending therethrough, said bore being aligned with a center of said elongate tube member, (b) a pen member slideably receivable in said knob member and said elongate tube member with a writing tip extended from the bore of the knob member, said pen member being removable from said roller assembly for use, (c) a paper roll positionable on said roller assembly, and (d) a housing being generally cylindrical with an open first end and a closed second end, said housing is generally hollow and has a slot through a perimeter wall, said slot being used to feed paper from said paper roll to a user as desired, said rolling assembly, pen member, and paper roll being positionable within said housing, said knob member extending from said open end of the housing to facilitate access by the user.

2. The pen and rolled note paper system of claim 1, wherein said housing further comprises a clip member positioned adjacent to said closed end, said clip member being adapted for coupling the system to clothing of the user.

3. The pen and rolled note paper system of claim 1, further comprising a cap member removably couplable to the housing adjacent to said open end, said cap member protects said pen member and said knob member when the system is not in use.

4. The pen and rolled note paper system of claim 3 wherein said cap member is transparent.

5. A pen and rolled note paper system comprising:

(a) a roller assembly having a elongate tube member and a knob member, said elongate tube member being hollow and substantially cylindrical, said elongate tube member having a first end and a second end, wherein said knob member is operationally coupled to said first end of said elongate tube member, said knob member having a bore extending therethrough, said bore being aligned with a center of said elongate tube member (b) a pen member slideably receivable in said knob member and said elongate tube member with a writing tip extended from the bore of the knob member, said pen member being removable from said roller assembly for use, wherein said knob member includes a knurled perimeter wall to facilitate being grasped by a human hand, said knob being movable in a forward direction to allow the paper to be written on and movable in a backward direction to manually store the written information, (c) a paper roll positionable on said roller assembly, said paper roll has an overall length of approximately 72 inches, said paper roll has a plurality of perforations facilitating tearing the paper to a desired length prior to use, said paper roll has a width of 4 inches and is perforated every three inches, facilitating dispensing 4 inch by 3 inch notes, (d) a housing being generally cylindrical with an open first end and a closed second end, said housing is generally hollow and has a slot through a perimeter wall, said slot being used to feed paper from said paper roll to a user as desired, said rolling assembly, pen member, and paper roll being positionable within said housing, said knob member extending from said open end of the housing to facilitate access by the user, (e) a clip member positioned adjacent to said closed end, said clip member being adapted for coupling the system to clothing of the user, (f) a cap member removably couplable to the housing adjacent to said open end, said cap member protects said pen member and said knob member when the system is not in use, (g) wherein said cap member is transparent, and (h) wherein said system has an overall length of 5½ inches and a circumference of 2½ inches.

* * * * *